US012674619B2

(12) United States Patent
Edake et al.

(10) Patent No.: US 12,674,619 B2
(45) Date of Patent: Jul. 7, 2026

(54) REFRIGERATOR AND CORRESPONDING SHELVING SYSTEM

(71) Applicant: WHIRLPOOL CORPORATION, Benton Harbor, MI (US)

(72) Inventors: Mahesh Edake, Pune (IN); Ravindra Mali, Pune (IN); Kailash Shravan More, Pune (IN); Shekhar Shetty, Cedar Rapids, IA (US); Kiran R Waghmare, Hingoli (IN)

(73) Assignee: Whirlpool Corporation, Benton Harbor, MI (US)

( * ) Notice: Subject to any disclaimer, the term of this patent is extended or adjusted under 35 U.S.C. 154(b) by 302 days.

(21) Appl. No.: 18/455,099

(22) Filed: Aug. 24, 2023

(65) Prior Publication Data

US 2025/0067504 A1 Feb. 27, 2025

(51) Int. Cl.
*F25D 25/02* (2006.01)

(52) U.S. Cl.
CPC ..... *F25D 25/02* (2013.01)

(58) Field of Classification Search
CPC . F25D 25/02; F25D 2325/022; A47B 96/027; A47B 96/021; A47B 96/062; A47B 96/02; A47B 96/028; A47B 57/42; A47B 96/024; A47B 96/061
See application file for complete search history.

(56) References Cited

U.S. PATENT DOCUMENTS

| | | | | |
|---|---|---|---|---|
| 870,439 | A * | 11/1907 | Kade | A47B 57/42 482/76 |
| 5,297,486 | A * | 3/1994 | Herrmann | A47B 96/062 248/250 |
| 5,660,777 | A * | 8/1997 | Herrmann | B29C 45/14434 264/154 |
| 7,237,855 | B2 | 7/2007 | Vardon | |
| 7,850,805 | B2 | 12/2010 | Vardon | |
| 8,231,191 | B2 | 7/2012 | Leconte et al. | |
| 2004/0264160 | A1* | 12/2004 | Bienick | F25D 27/00 362/23.15 |
| 2005/0280341 | A1* | 12/2005 | Vardon | F25D 25/02 312/408 |

(Continued)

FOREIGN PATENT DOCUMENTS

| | | | | |
|---|---|---|---|---|
| CN | 112984941 | A * | 6/2021 | F25D 25/02 |
| KR | 100498551 | B1 | 7/2005 | |
| KR | 20190019451 | A * | 2/2019 | F25D 25/02 |

OTHER PUBLICATIONS

CN112984941 translation (Year: 2021).*

*Primary Examiner* — Hiwot E Tefera
(74) *Attorney, Agent, or Firm* — Brooks Kushman P.C.

(57) ABSTRACT

A refrigerator shelf includes a plate, a frame, and a support arm. The plate is configured to support items disposed within a refrigerator. The frame supports the plate and has a brace extending downward from a bottom surface of the frame. The brace has an edge. The support arm has a flange extending laterally along an upper region of the support arm. The support arm has a tab extending upward from an end of the flange. The frame is coupled to the support arm via the brace engaging an upper surface of the flange and via the tab engaging the edge of the brace. The support arm is configured to engage the refrigerator to position the shelf within the refrigerator.

20 Claims, 10 Drawing Sheets

(56) References Cited

U.S. PATENT DOCUMENTS

| | | | | |
|---|---|---|---|---|
| 2006/0145577 | A1* | 7/2006 | Daley | A47B 96/021 312/408 |
| 2006/0213849 | A1* | 9/2006 | Bienick | F25D 25/02 211/90.02 |
| 2008/0000260 | A1* | 1/2008 | Lim | F25D 23/067 62/465 |
| 2008/0202146 | A1* | 8/2008 | Lim | F25D 25/025 62/382 |
| 2009/0134758 | A1* | 5/2009 | Vardon | F25D 25/02 312/408 |
| 2011/0001416 | A1* | 1/2011 | Escalettes | F25D 25/02 29/447 |
| 2012/0104925 | A1* | 5/2012 | Nash | F25D 25/02 29/428 |
| 2018/0106531 | A1* | 4/2018 | Bhavsar | B29C 45/14336 |
| 2020/0323342 | A1* | 10/2020 | Chavan | A47B 96/02 |
| 2021/0274935 | A1* | 9/2021 | Celik | F25D 25/02 |
| 2023/0145594 | A1* | 5/2023 | Garcia | F25D 25/02 312/404 |

* cited by examiner

REFRIGERATOR AND CORRESPONDING SHELVING SYSTEM

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator shelf includes a plate, a frame, and a second support arm. The plate is configured to support items disposed within a refrigerator. The frame supports the plate. The frame has first and second side beams. The first and second side beams each have a forward-facing surface and a rearward-facing surface. The first and second support arms each have first and second flanges extending laterally inward along upper regions of the first and second support arms, respectively. First and second tabs extending upward from forward and rearward ends of the first flange, respectively. Third and fourth tabs extending upward from forward and rearward ends of the second flange, respectively. Hooks extending outward from rearward regions of the support arms. The frame is coupled to the first and second support arms via the first and second side beams engaging upper surfaces of the flanges of the first and second support arms, respectively; the first and second tabs engaging the forward-facing and rearward-facing surfaces of the first side beam, respectively; and the third and fourth tabs engaging the forward-facing and rearward-facing surfaces of the second side beam, respectively. The hooks are configured to engage the refrigerator to position the shelf within the refrigerator.

A refrigerator shelf includes a plate, a frame, and a support arm. The plate is configured to support items disposed within a refrigerator. The frame supports the plate and has a brace extending downward from a bottom surface of the frame. The brace has an edge. The support arm has a flange extending laterally along an upper region of the support arm. The support arm has a tab extending upward from an end of the flange. The frame is coupled to the support arm via the brace engaging an upper surface of the flange and via the tab engaging the edge of the brace. The support arm is configured to engage the refrigerator to position the shelf within the refrigerator.

A refrigerator shelf includes a plate, a frame, and a support arm. The plate is configured to support items disposed within a refrigerator. The frame supports the plate. The frame has an array of bosses extending downward from a bottom surface of the frame. The support arm has a flange extending laterally along an upper region of the support arm. The flange defines an array of orifices. The frame is coupled the support arm via the array of bosses engaging the frame within the array of orifices. The support arm is configured to engage the refrigerator to position the shelf within the refrigerator.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
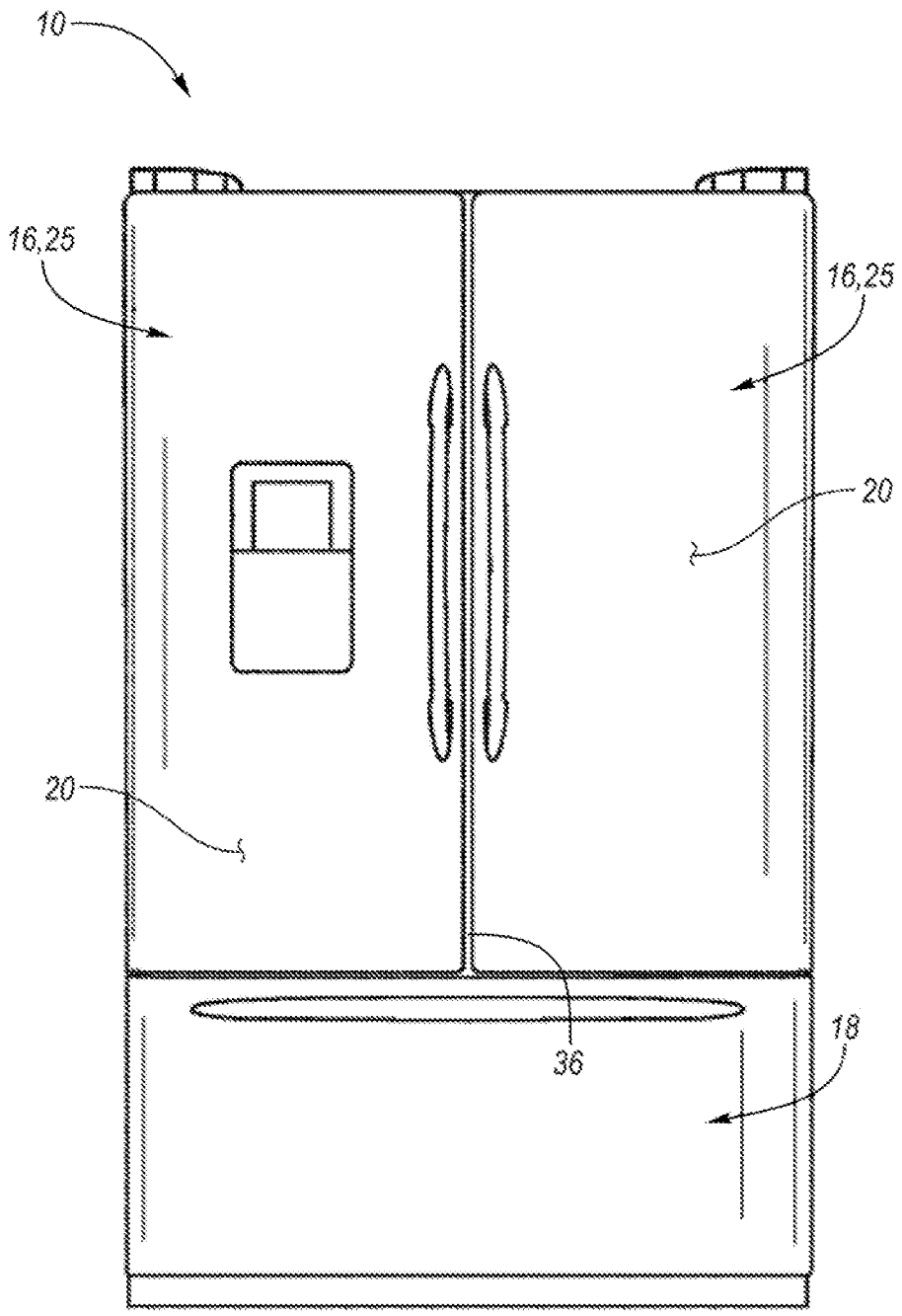
FIG. 1 is a front view of a French-Door Bottom Mount type refrigerator appliance.
Figure 2:
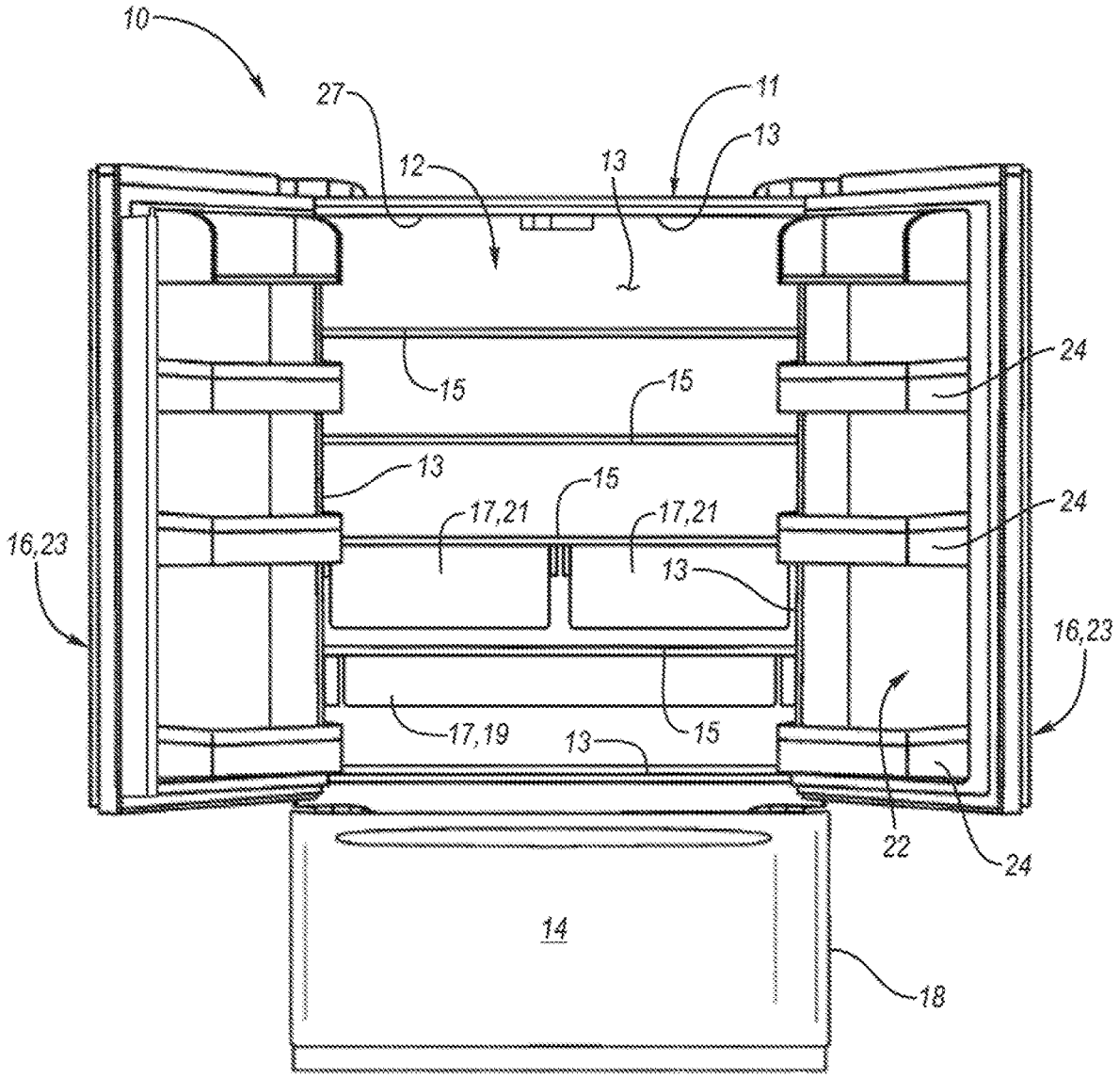
FIG. 2 is a front view of a French-Door Bottom Mount type refrigerator with the refrigerator compartment doors open.
Figure 3:
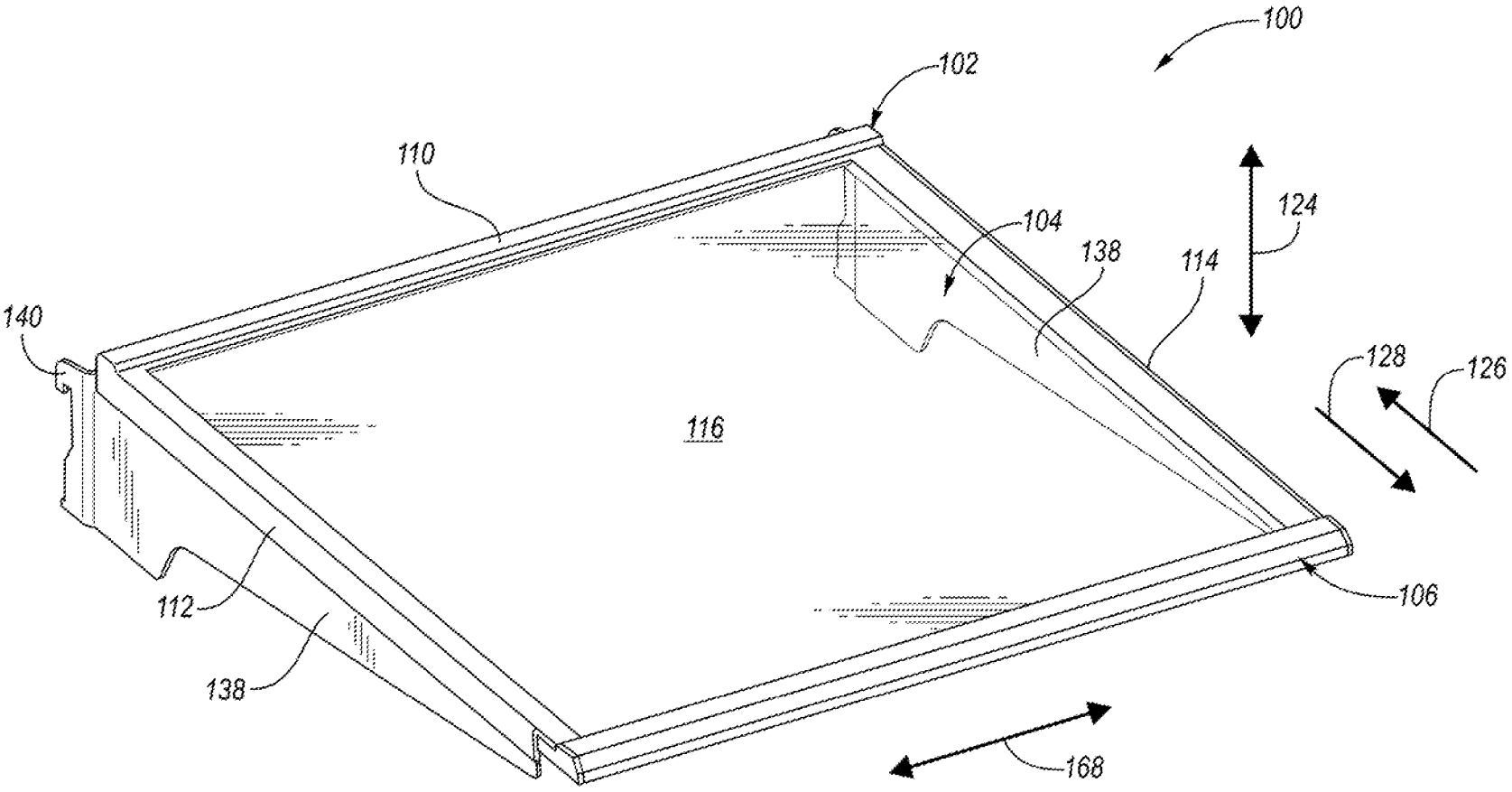
FIG. 3 is a top isometric view of a first embodiment of a refrigerator shelf.
Figure 4:
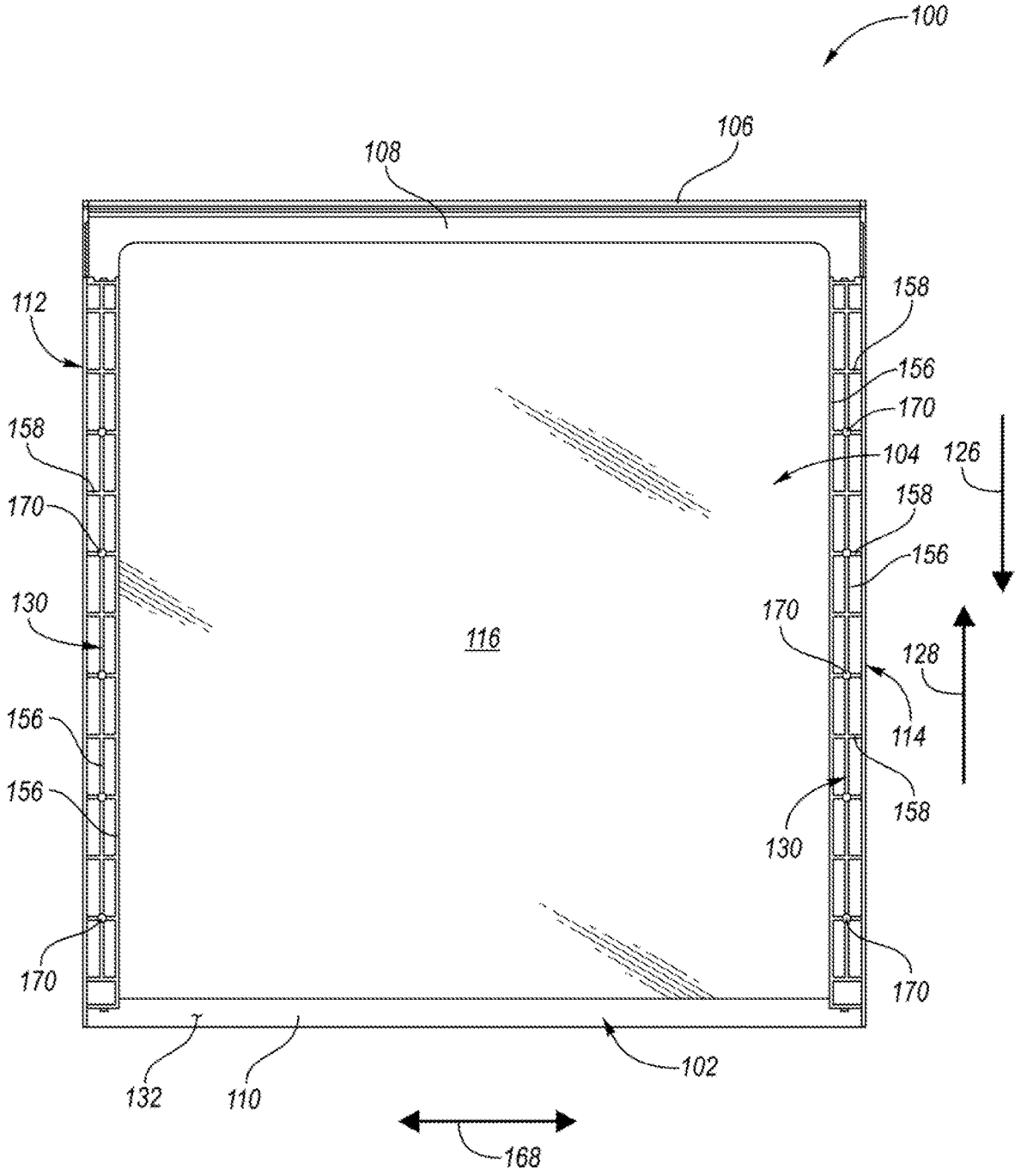
FIG. 4 is a bottom view of a frame and a support plate for the first embodiment of the refrigerator shelf.
Figure 5:
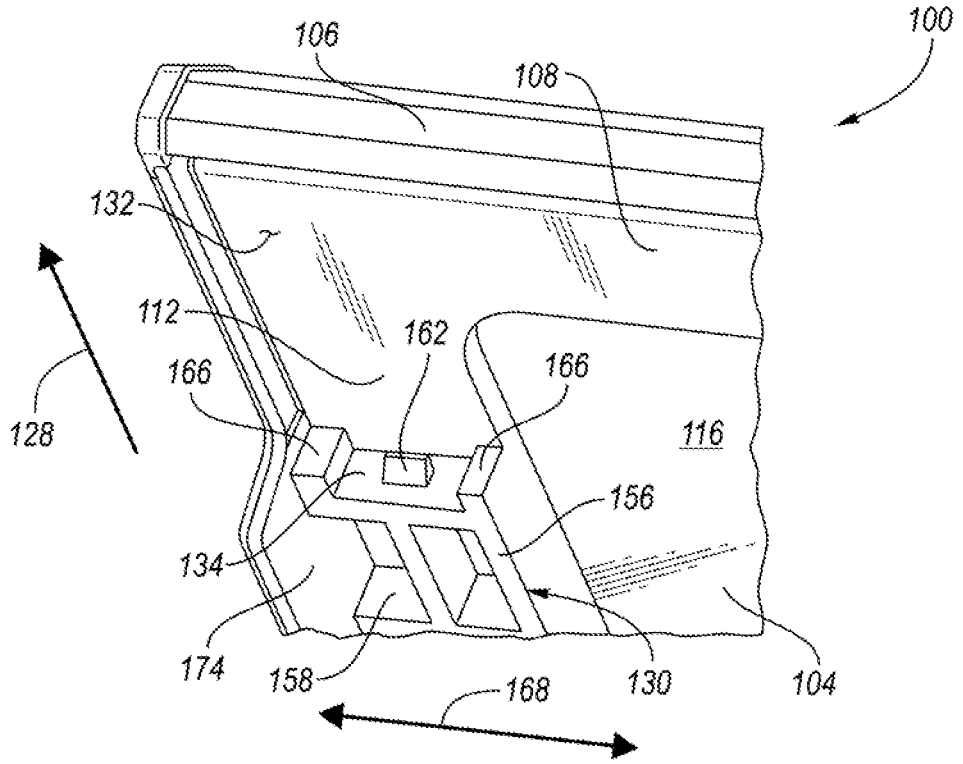
FIG. 5 is a lower partial isometric view of a front end of the frame and support plate for first embodiment of the refrigerator shelf.
Figure 6:
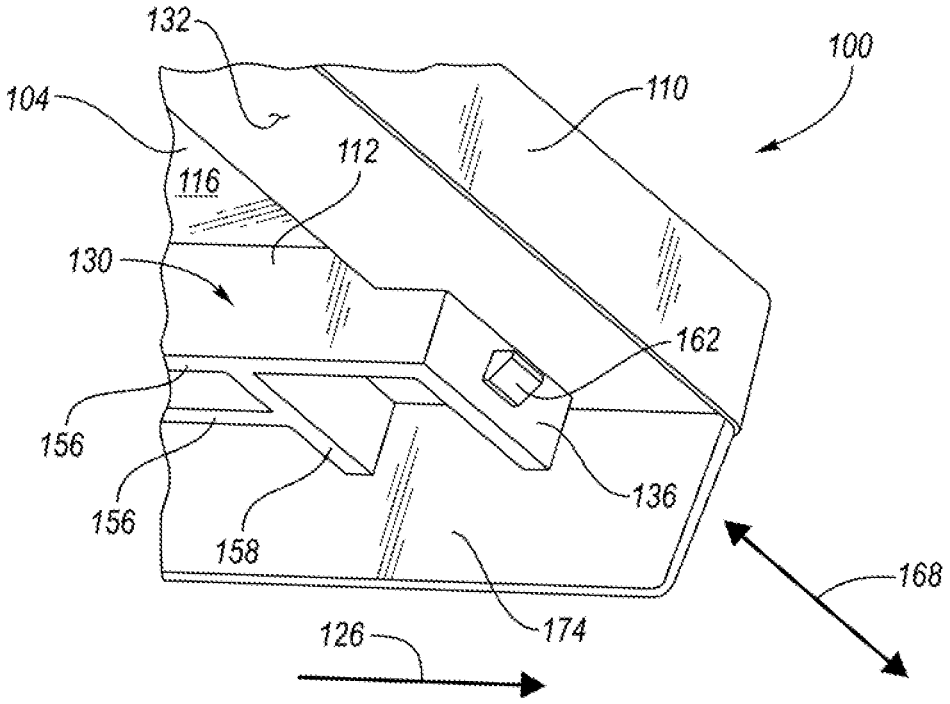
FIG. 6 is a lower partial isometric view of a rear end of the frame and support plate for the first embodiment of the refrigerator shelf.
Figure 7:
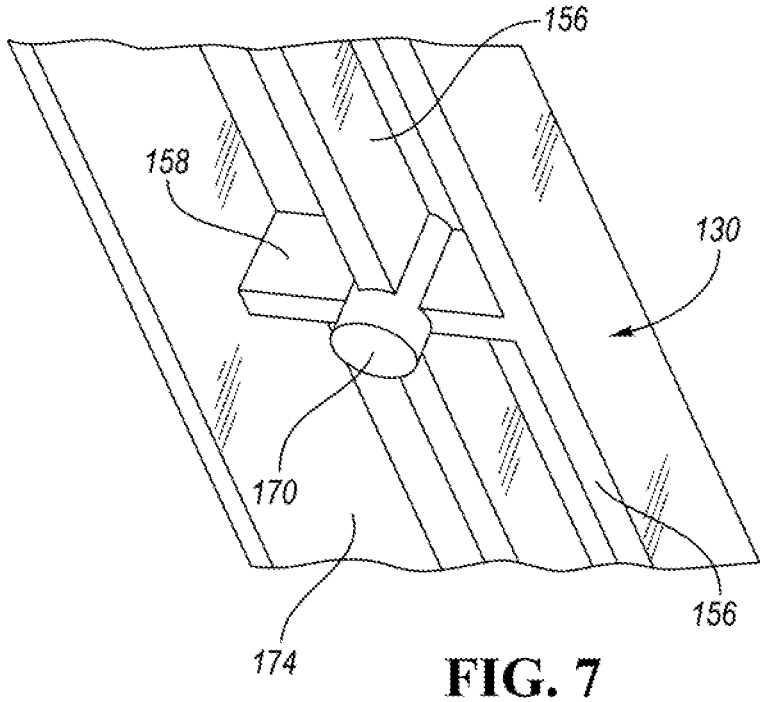
FIG. 7 is a lower partial isometric view of a portion of a brace that extends from a frame of the first embodiment of the refrigerator shelf.
Figure 8:
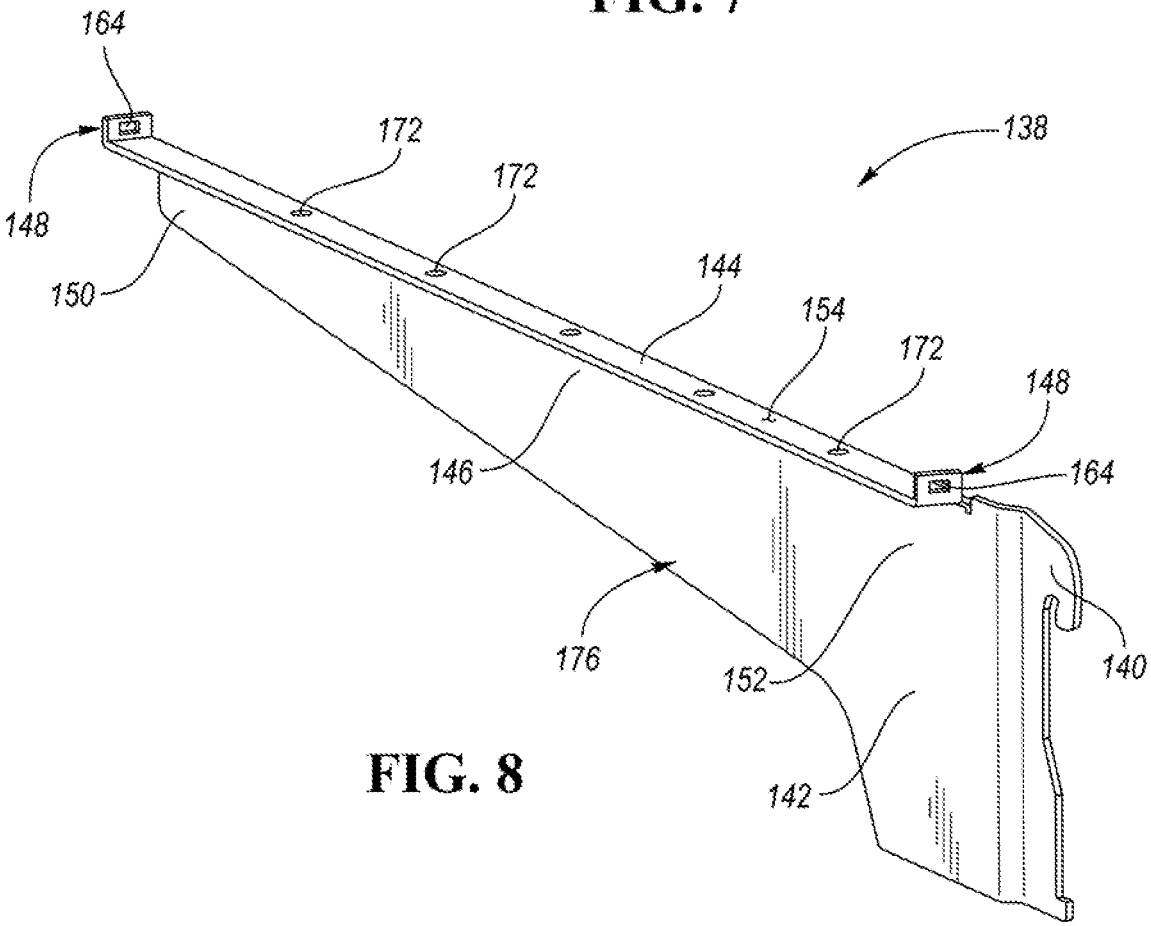
FIG. 8 is an internal isometric view of a support arm of the first embodiment of the refrigerator shelf.
Figure 10:
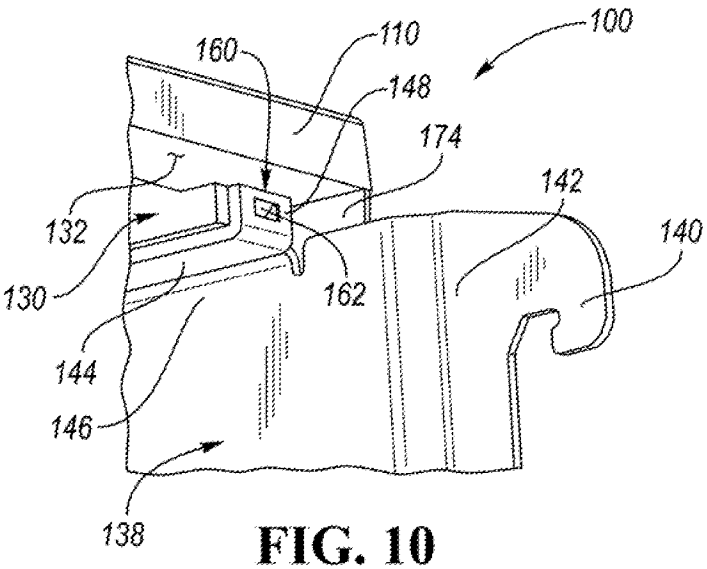
FIG. 10 is a partial rear isometric view of a rear end of the first embodiment of refrigerator shelf illustrating an engagement between the frame of the first embodiment of refrigerator shelf and a rear end of the arm of the first embodiment of refrigerator shelf.
Figure 9:
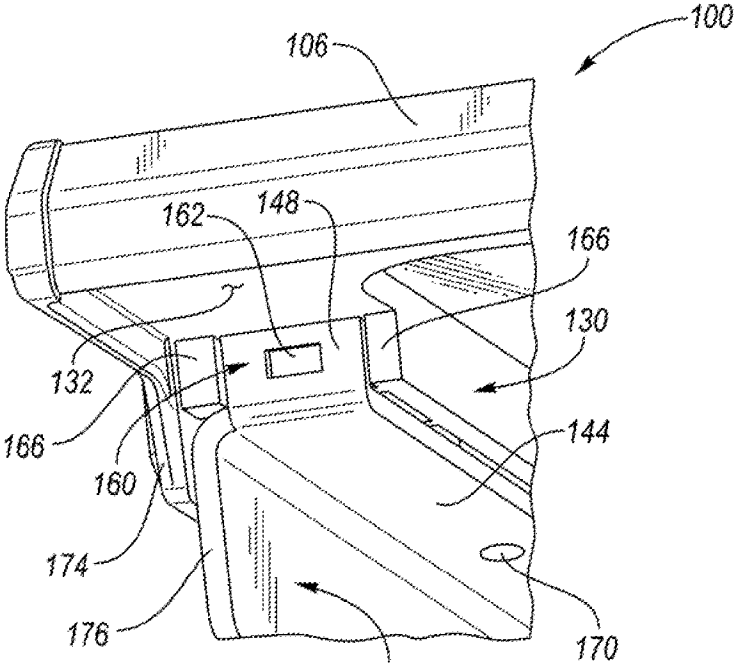
FIG. 9 is a partial front isometric view of a front end of the first embodiment of refrigerator shelf illustrating an engagement between the frame of the first embodiment of the refrigerator shelf and a front end of the arm of the first embodiment of the refrigerator shelf.

Referring to FIGS. 1 and 2, generally a refrigerator 10 of the French-Door Bottom Mount type is illustrated. However, it should be understood that this disclosure could apply to any type of refrigerator, such as a side-by-side, two-door bottom mount, or a top-mount type. As shown in FIGS. 1 and 2, the refrigerator 10 may have a cabinet 11 or housing defining a first internal storage chamber, internal cavity, or fresh food compartment 12 configured to refrigerate and not freeze consumables or foodstuffs within the fresh food compartment 12, and a second internal storage chamber, internal cavity, or a freezer compartment 14 configured to freeze consumables or foodstuffs within the freezer compartment 14 during normal use. The refrigerator 10 includes panels or walls 13 that form the cabinet 11 or housing and define the fresh food compartment 12 and the freezer compartment 14. The walls 13 may more specifically form an internal liner of the refrigerator 10. The walls 13 may include a rear or back wall, a top wall, a bottom wall, and two side walls.

One or more shelves 15 may be secured to the walls 13 within the fresh food compartment 12. One or more drawers 17 may be slidably secured to the shelves 15 or the walls within the fresh food compartment 12. More specifically, the drawers 17 may be slidably secured to the shelves 15 or the walls within the fresh food compartment 12 via tracks or rails. One or more of the drawers 17 may be either a pantry drawer 19 or a crisper drawer 21. Crisper drawer 21 may more specifically be drawers defining a storage space that is kept at a desired humidity that may be different from the remainder of the fresh food compartment 12, but that is optimal for maintaining freshness of fruits and vegetables.

The refrigerator 10 may have one or more doors 16, 18 that provide selective access to the interior volume of the refrigerator 10 where consumables may be stored. As shown, the fresh food compartment doors are designated 16, and the freezer door is designated 18. The doors 16 may be configured to transition between open positions 23 and closed positions 25. The doors 16 may cover an opening 27 to the internal cavity (e.g., fresh food compartment 12) in the closed positions 25. The doors 16 may provide access to the internal cavity via the opening 27 in the open positions 23. It may also be shown that the fresh food compartment 12 may only have one door 16 as opposed to two doors 16 as illustrated. The doors 16 may be rotatably secured to the cabinet 11 by one or more hinges.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The doors 16 may each include an exterior panel 20 and an interior panel 22 that is disposed on an internal side of the respective exterior panel 20 of each door 16. The interior panels 22 may be configured to face the fresh food compartment 12 when the doors 16 are in closed positions (See FIG. 1). The interior panel 22 may more specifically be a door liner. An insulating material, such as an insulating foam, may be disposed between the exterior panel 20 and interior panel 22 of each door 16 in order reduce the heat transfer from the ambient surroundings and increase the efficiency of the refrigerator.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The doors 16 may also include storage bins 24 that are able to hold food items or containers. The storage bins 24 may be secured to the interior panels 22 of each door 16. Alternatively, the storage bins 24 may integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves (e.g., a lower surface upon, which a food item or container may rest upon) that extend from back and/or side surfaces of the interior panels 22 of each door 16.

Referring to FIGS. 3-10, a first embodiment of a refrigerator shelf 100 is illustrated. The shelf 100 may be utilized as a shelf within a compartment of the refrigerator 10 (e.g., the fresh food compartment 12 or the freezer compartment 14). For example, the shelf 100 may be utilized as shelf 15 illustrated in FIG. 2. The shelf 100 includes a frame 102, a panel or plate 104 (e.g., a glass plate) that is configured to support items (e.g., food items) that are disposed within the refrigerator 10, and a trim or edge cover 106. The frame 102 provides structural support for the plate 104.

The frame 102 includes a front beam 108, a rear beam 110, a first side beam 112, and a second side beam 114. The front beam 108 is spaced-apart from the rear beam 110. The first side beam 112 is spaced-apart from the second side beam 114. The front beam 108 and rear beam 110 each span and are each secured to the first and second side beams 112, 114 such that a central opening 116 is defined between the front beam 108, rear beam 110, first side beam 112, and second side beam 114. The plate 104 spans the front beam 108 and rear beam 110, and spans the first and second side beams 112, 114 such that the plate 104 is disposed within an entirely of the central opening 116. The front beam 108, rear beam 110, first side beam 112, and/or second side beam 114 may encapsulate an outer peripheral edge of the plate 104.

The plate 104 is disposed on top of an upper surface that is collectively formed by the front beam 108, the rear beam 110, the first side beam 112, and the second side beam 114. The rear beam 110 may define a C-channel above the upper surface that is collectively formed by the front beam 108, the rear beam 110, the first side beam 112, and the second side beam 114. The C-channel may receive a rearward edge of the plate 104. The C-channel may restrict movement of the plate 104 upward and downward in a vertical direction 124, particularly along the rearward edge of the plate 104, and may restrict movement of the plate 104 in a direction 126 extending from the front beam 108 toward the rear beam 110.

The edge cover 106 engages a forward edge of the front beam 108. The edge cover 106 also engages a forward edge of the plate 104 to restrict movement of the plate 104 in a direction 128 extending from the rear beam 110 toward the front beam 108. The edge cover 106 also engages a top or top surface of the plate 104 to further restrict movement of the plate 104 in the vertical direction 124, particularly along the forward edge of the plate 104.

The frame 102 further includes braces 130 extending downward from a bottom surface 132 of the frame 102. More specifically, the braces 130 extend downward from the first and second side beams 112, 114. The frame 102 includes forward-facing edges or surfaces 134 and rearward-facing edges or surfaces 136. More specifically, the forward-facing edges or surfaces 134 and the rearward-facing edges or surfaces 136 may extend downward from and may be positioned along the bottoms of the first and second side beams 112, 114 and between the front and rear beams 108, 110. Even more specifically, the forward-facing edges or surfaces 134 and rearward-facing edges or surfaces 136 may comprise forward-facing edges or surfaces and rearward-facing edges or surfaces of the braces 130.

The forward-facing edges or surfaces 134 and rearward-facing edges or surfaces 136 may be substantially perpendicular to the bottom surface 132 of the frame 102. Substantially perpendicular may refer to any incremental angle that is between exactly perpendicular and 150 from exactly perpendicular.

The refrigerator shelf 100 further includes support arms 138. More specifically, the support arms 138 may include first and second support arms, which may be mirror images of each other. Therefore, it should be understood that the description of one of the support arms 138 is applicable to the other of the support arms 138 keeping in mind that the support arms 138 are mirror images of each other. The support arms 138 are configured to engage the refrigerator 10 to position the shelf 100 within the refrigerator 10. More specifically, the support arms 138 may be configured to engage a wall 13 (e.g., the rear wall 13) within the fresh food compartment 12 or the freezer compartment 14 to position the shelf 100 within the fresh food compartment 12 or the freezer compartment 14.

The support arms 138 may each include hooks 140 extending outward from rearward regions 142 of the support arms 138. The hooks 140 may be configured to engage the refrigerator 10 to position the shelf 100 within the refrigerator 10. More specifically, the hooks 140 may be configured to engage orifices or slots (not shown) defined by a wall 13 (e.g., the rear wall 13) within the fresh food compartment 12 or the freezer compartment 14 to position the shelf 100 within the fresh food compartment 12 or the freezer compartment 14. Such orifices or slots may be arranged in a "ladder" configuration that includes a plurality of orifices or slots so that the hooks 140 may engage the orifices or slots arranged at different heights to adjust the height of the shelf 100 within the fresh food compartment 12 or the freezer compartment 14.

The support arms 138 each include a flange 144 that extends laterally outward from an upper region 146 of the corresponding support arm 138. The flanges 144 may extend laterally inward along the upper regions 146 of the support arms 138 with respect to the frame 102 and plate 104 once the support arms 138 are assembled onto or secured to the frame 102. The support arms 138 each include two tabs 148, where (i) a first of the tabs 148 extends upward from a forward end 150 of the respective support arm 138 and (ii) a second of the tabs 148 extends upward from a rearward end 152 of the respective support arm 138. More specifically, the first of the tabs 148 may extend upward from a forward end of the respective flange 144 and the second of the tabs 148 may extend upward from a rearward end of the respective flange 144.

The tabs 148 of each support arm 138 may be substantially perpendicular to the corresponding flange 144 on the support arm 138. Substantially perpendicular may refer to any incremental angle that is between exactly perpendicular and 150 from exactly perpendicular.

The frame 102 may be coupled to the support arms 138' (i) via the first side beam 112 (or a first of the braces 130) engaging an upper surface 154 of the flange 144 of a first of the support arms'; (ii) the second side beam 114 (or a second of the braces 130) engaging an upper surface 154 of the flange 144 of a second of the support arms 138; (iii) first and second tabs 148 of the first of the support arms 138 engaging the forward-facing edge or surface 134 and rearward-facing edge or surface 136 of the first side beam 112 (or a first of the braces 130), respectively; and (iv) first and second tabs 148 of the second of the support arms 138 engaging the forward-facing edge or surface 134 and rearward-facing edge or surface 136 of the second side beam 114 (or a second of the braces 130), respectively.

The braces 130 each comprise arrangements of longitudinally extending girders 156 and transversely extending ribs 158. The braces 130, or more specifically the girders 156 and transversely extending ribs 158, may increase the structural rigidity of the frame 102, particularly in the region (e.g., along the first and second side beams 112, 114) where the frame 102 engages the support arms 138. Generally, a brace may correspond to a part that adds physical strength or support; or something that transmits, directs, resists, or supports weight or pressure.

Each tab 148 and the corresponding surface (e.g., the forward-facing edge or surface 134 or rearward-facing edge or surface 136 of the first and second side beams 112, 114) of the frame 102 that engages the corresponding tab 148 may collectively include or form a clip or snap 160 that is configured to secure a correspond support arm 138 to the frame 102 or subcomponent of the frame (e.g., brace 130, first side beam 112, or second side beam 114).

For example, a first tab 148 of a first of the support arms 138 and the forward-facing edge or surface 134 of the first side beam 112 (or a first of the braces 130) may collectively include or form a first of the clips or snaps 160, a second tab 148 of the first of the support arms 138 and the rearward-facing edge or surface 136 of the first side beam 112 (or a first of the braces 130) may collectively include or form a second of the clips or snaps 160, a third tab 148 of a second of the support arms 138 and the forward-facing edge or surface 134 of the second side beam 114 (or a second of the braces 130) may collectively include or form a third of the clips or snaps 160, and (iv) a fourth tab 148 and the rearward-facing edge or surface 136 of the second side beam 114 (or a second of the braces 130) may collectively include or form a fourth of the clips or snaps 160, where the first and second of the clips or snaps 160 are configured to secure the first of the support arms 138 to the first side beam 112 (or a first of the braces 130) and the third and fourth of the clips or snaps 160 are configured to secure the second of the supports arm to the second side beam 114.

Each of the clips or snaps 160 includes a ramped protrusion or tab 162 extending from frame 102 and an aperture or orifice 164 defined by a corresponding tab 148, where a ramped surface of each ramped protrusion or tab 162 is configured to guide the ramped protrusions or tabs 162 toward corresponding orifices 164 during installation of the support arms 138 onto the frame 102 and where the tabs 148 are configured to flex outward and then snap back such the ramped protrusions or tabs 162 are enclosed and secured within corresponding orifices 164.

For example, a first of the snaps 160 may include a first of the ramped protrusions or tabs 162 that extends from the forward-facing edge or surface 134 of the first side beam 112 and a first of the orifices 164 that is defined by a first of the tabs 148, a second of the snaps 160 may include a second of the ramped protrusions or tabs 162 that extends from the rearward-facing edge or surface 136 of the first side beam 112 and a second of the orifices 164 that is defined by a second of the tabs 148, a third of the snaps 160 may include a third of the ramped protrusions or tabs 162 that extends from the forward-facing edge or surface 134 of the second side beam 114 and a third of the orifices 164 that is defined by a third of the tabs 148, and a fourth of the snaps 160 may include a fourth of the ramped protrusions or tabs 162 that extends from the rearward-facing edge or surface 136 of the second side beam 114 and a fourth of the orifices 164 that is defined by a fourth of the tabs 148.

It is noted that the configuration could be rearranged (e.g., the ramped protrusions or tabs 162 could extend from the tabs 148 while the forward-facing edge or surface 134 and the rearward-facing edge or surface 136 could define the orifices 164).

The first and second side beams 112, 114 (or the braces 130) may include projections or protrusions 166 that extend forward (e.g., in direction 128) and outward from opposing sides of the forward-facing edges or surfaces 134. Although not illustrated, such protrusions 166 may also extend rearward (e.g., in direction 126) and outward from opposing sides of the rearward-facing edges or surfaces 136 from the first and second side beams 112, 114 (or the braces 130). The projections or protrusions 166 are configured engage opposing sides of the correspond tabs 148 that are engaging either the forward-facing edges or surfaces 134 or the rearward-facing edges or surfaces 136 to restrict lateral movement of the support arms 138 relative to the frame 102. Lateral movement may refer to movement in a direction 168 that extends between the first and second side beams 112, 114.

The frame 102 may include one or bosses 170 extending downward from the bottom surface 132. The bosses 170 may more specifically extend downward from the first and second side beams 112, 114 (or the braces 130). The bosses 170 may extend or protrude from the braces 130 at intersections between the longitudinally extending girders 156 and transversely extending ribs 158. If there are more than one, the bosses 170 may be arranged in a pattern or in an array.

For example, the bosses 170 may be arranged in a linear pattern. The flanges 144 may define apertures or orifices 172. The orifice 172 may also be arranged in a pattern or array that matches the pattern or array of the bosses 170. Each boss 170 extends into a corresponding orifice 172 and engages a corresponding support arm 138 within the corresponding orifice 172 to couple the support arms 138 to the frame or more specifically to the first and second side beams 112, 114 (or the braces 130).

It is noted that the configuration could be rearranged (e.g., the bosses 170 could extend upward from the flanges 144 and the orifices 172 could be defined by the first and second side beams 112, 114 (or by the braces 130). The frame 102, or more specifically the first and second side beams 112, 114, may include overhanging flaps 174 that overlap with side panels 176 of the support arms 138. The overhanging flaps 174 may operate to restrict laterally outward movement of the support arms 138 (e.g., outward movement in direction 168) relative to the frame 102.

Figure 11:
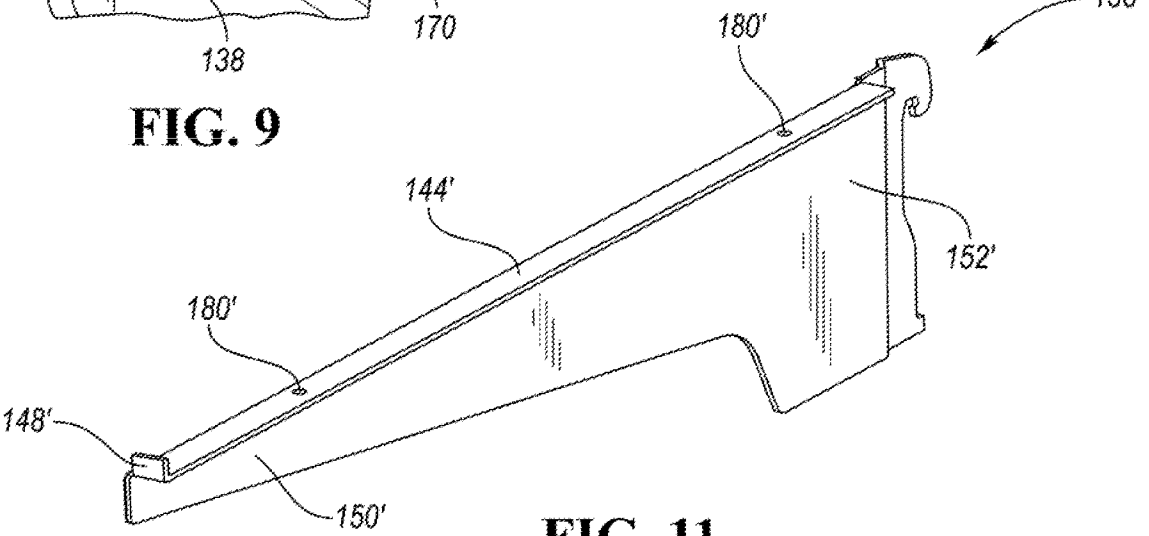
FIG. 11 is an internal isometric view of a support arm of a second embodiment of the refrigerator shelf.
Figure 12:
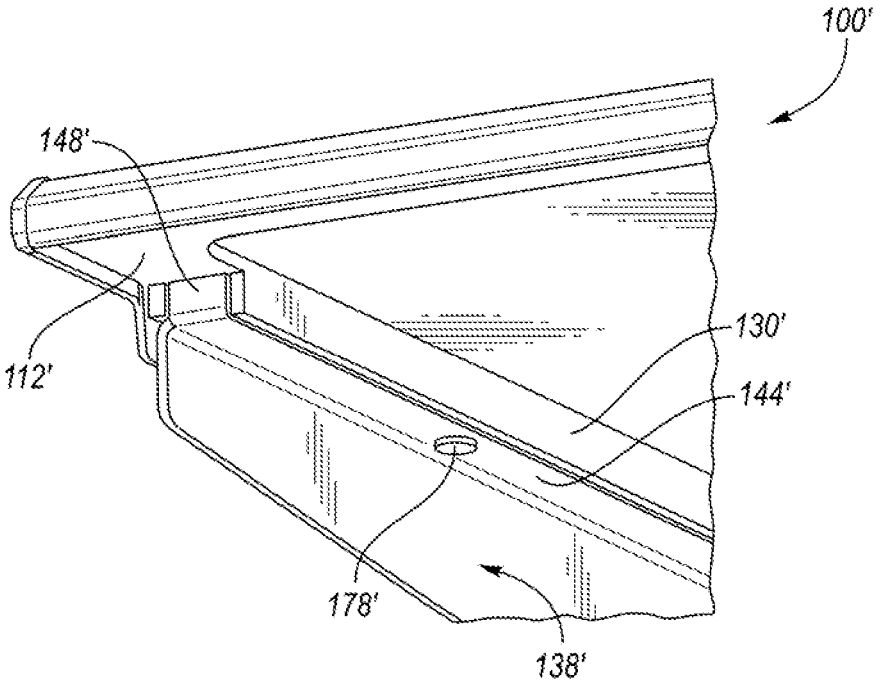
FIG. 12 is a partial front isometric view of a front end of the second embodiment of refrigerator shelf illustrating an engagement between a frame of the second embodiment of refrigerator shelf and a front end of the arm of the second embodiment of refrigerator shelf.
Figure 13:
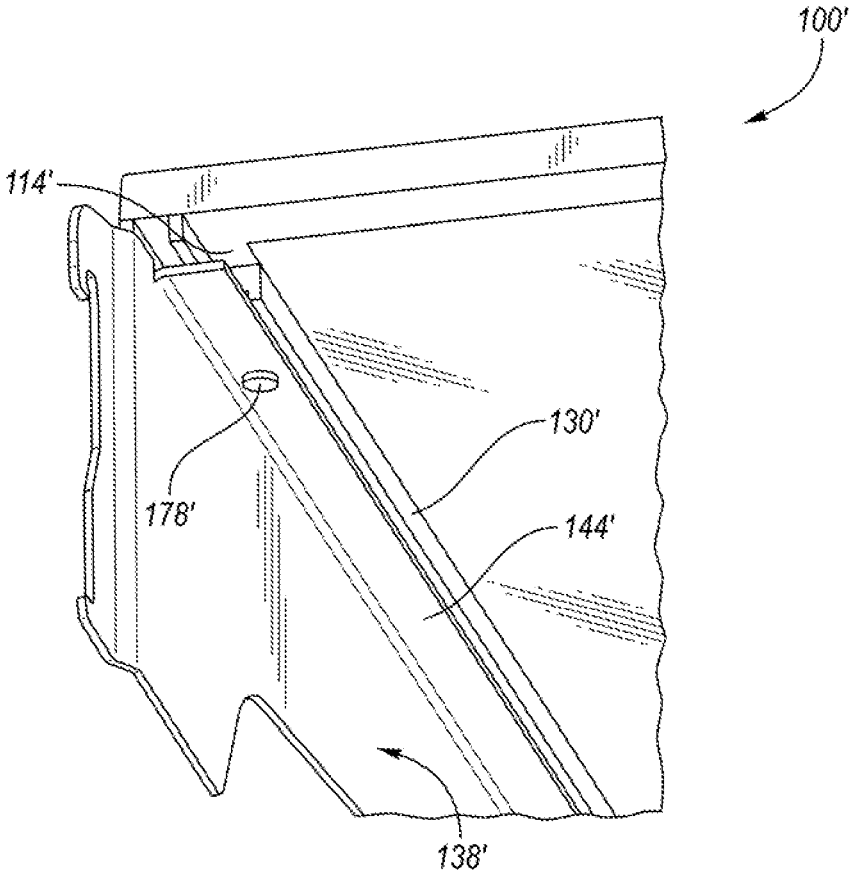
FIG. 13 is a partial rear isometric view of a rear end of the second embodiment of refrigerator shelf illustrating an engagement between the frame of the second embodiment of refrigerator shelf and a rear end of the arm of the second embodiment of refrigerator shelf.

Referring to FIGS. 11-13, a second embodiment of the refrigerator shelf 100' is illustrated. The second embodiment of the refrigerator shelf 100' may be construed to include all of the elements, subcomponents, and functionality of the first embodiment of the refrigerator shelf 100 unless otherwise stated or illustrated herein. It should further be understood that any component having a callout number in FIGS. 11-13 that includes a prime symbol (') may be construed as having the same structure, subcomponents, and functionality as a component illustrated in FIGS. 3-10 that includes the same callout number but without the prime symbol, unless otherwise stated or illustrated herein.

The second embodiment of the refrigerator shelf 100' may not include the tabs 148' that extend upward from a rearward end 152' of the respective support arm 138'; the tabs 148' that extend upward from a forward end 150' of the respective support arm 138' may not include or form a clip or snap; the first and second side beams 112', 114' (or the braces 130') may not include the bosses; the flanges 144' may not include the corresponding orifices that interact with the bosses; and fasteners 178' may extend through orifices 180' defined by the flanges 144' and engage the first and second side beams 112', 114' (or the braces 130') to secure the support arms 138' to the frame 102'. The fasteners 178' may be self-tapping fasteners that engage the first and second side beams 112', 114' (or the braces 130'). More specifically, the fasteners 178' may be self-tapping fasteners that engage the first and second side beams 112', 114' (or the braces 130') within orifices defined by the first and second side beams 112', 114' (or the braces 130'). Such offices defined by the first and second side beams 112', 114' (or the braces 130') may be positioned at the intersections between the longitudinally extending girders and transversely extending ribs of the braces 130'. For example, the bosses 170 that extend from the braces 130 of refrigerator shelf 100 may be replaced by protrusions or projections that define centrally located orifices to form the braces 130'.

Figure 14:
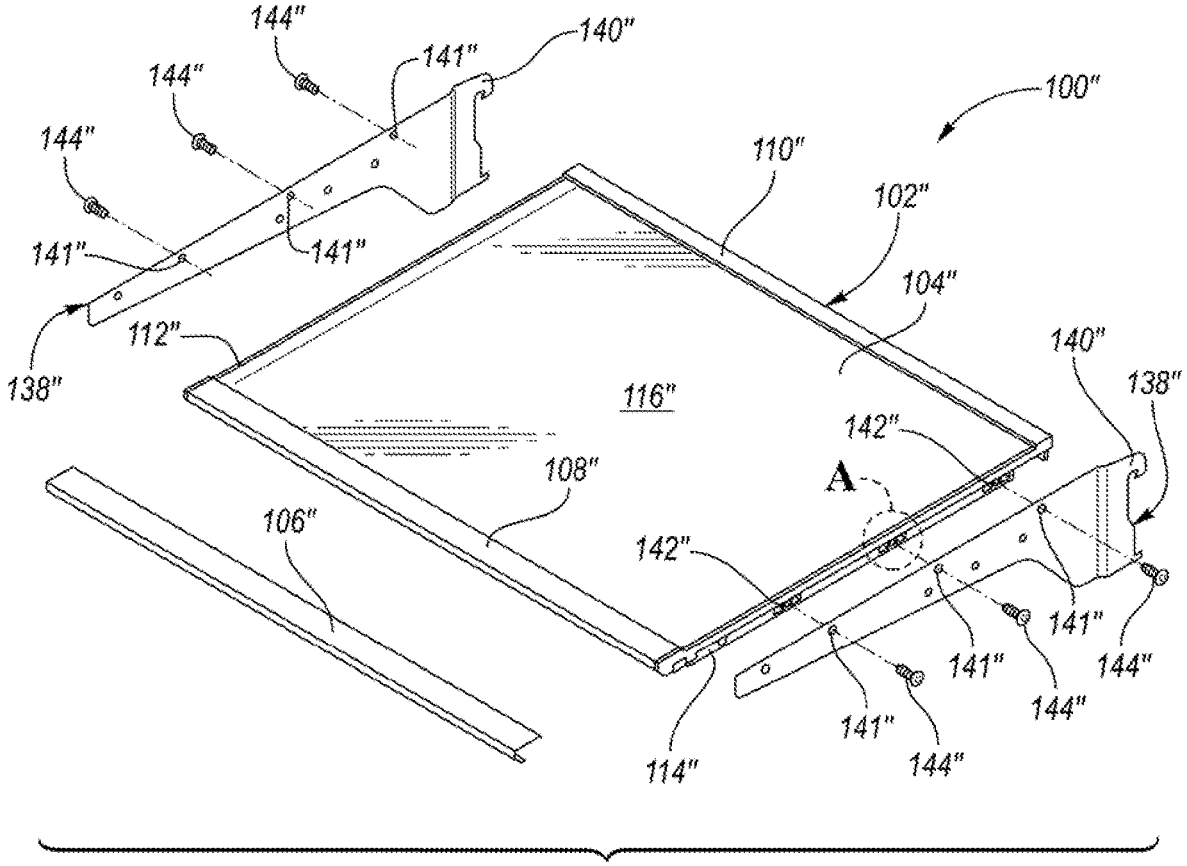
FIG. 14 is an exploded view of a third embodiment of the refrigerator shelf.
Figure 15:
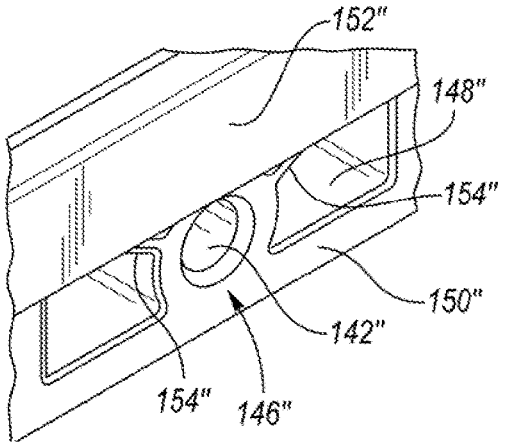
FIG. 15 is a magnified view of area A in FIG. 14.

Referring to FIGS. 14 and 15, a third embodiment of the refrigerator shelf 100" is illustrated. The third embodiment of the refrigerator shelf 100" may be construed to include all of the elements, subcomponents, and functionality of the first embodiment of the refrigerator shelf 100 and/or the second embodiment of the refrigerator shelf 100' unless otherwise stated or illustrated herein. It should further be understood that any component having a callout number in FIGS. 14 and 15 that includes a double prime symbol (") may be construed as having the same structure, subcomponents, and functionality as a component illustrated in FIGS. 3-10 that includes the same callout number but without the prime symbol and/or a component illustrated in FIGS. 11-13 that includes the same callout number but with only one the prime symbol, unless otherwise stated or illustrated herein.

The third embodiment of the refrigerator shelf 100" may be utilized as a shelf within a compartment of the refrigerator 10 (e.g., the fresh food compartment 12 or the freezer compartment 14). For example, the shelf 100" may be utilized as shelf 15 illustrated in FIG. 2. The shelf 100" includes a frame 102", a panel or plate 104" (e.g., a glass plate) that is configured to support items (e.g., food items) that are disposed within the refrigerator 10, and a trim or edge cover 106". The frame 102" provides structural support for the plate 104".

The frame 102" includes a front beam 108", a rear beam 110", a first side beam 112", and a second side beam 114". The front beam 108" is spaced-apart from the rear beam 110". The first side beam 112" is spaced-apart from the second side beam 114". The front beam 108" and rear beam 110" each span and are each secured to the first and second side beams 112", 114" such that a central opening 116" is defined between the front beam 108", rear beam 110", first side beam 112", and second side beam 114". The plate 104" spans the front beam 108" and rear beam 110", and spans the first and second side beams 112", 114" such that the plate 104" is disposed within an entirely of the central opening 116". The front beam 108", rear beam 110", first side beam 112", and/or second side beam 114" may encapsulate an outer peripheral edge of the plate 104".

The refrigerator shelf 100" further includes support arms 138". More specifically, the support arms 138" may include first and second support arms, which may be mirror images of each other. Therefore, it should be understood that the description of one of the support arms 138" is applicable to the other of the support arms 138" keeping in mind that the support arms 138" are mirror images of each other. The support arms 138" are configured to engage the refrigerator 10 to position the shelf 100" within the refrigerator 10. More specifically, the support arms 138" may be configured to engage a wall 13 (e.g., the rear wall 13) within the fresh food compartment 12 or the freezer compartment 14 to position the shelf 100" within the fresh food compartment 12 or the freezer compartment 14.

The support arms 138" may each include hooks 140" extending outward from rearward regions of the support arms 138". The hooks 140" may be configured to engage the refrigerator 10 to position the shelf 100" within the refrigerator 10. More specifically, the hooks 140" may be configured to engage orifices or slots (not shown) defined by a wall 13 (e.g., the rear wall 13) within the fresh food compartment 12 or the freezer compartment 14 to position the shelf 100" within the fresh food compartment 12 or the freezer compartment 14. Such orifices or slots may be arranged in a "ladder" configuration that includes a plurality of orifices or slots so that the hooks 140" may engage the orifices or slots arranged at different heights to adjust the height of the shelf 100" within the fresh food compartment 12 or the freezer compartment 14.

A first of the support arms 138" may be secured to the first side beam 112" while a second of the support arms 138" is secured to the second side beam 114". The support arms 138" may define apertures or orifices 141". The orifices 141" may be arranged in a pattern or in an array. For example, the orifices 141" may be arranged in a linear pattern. The first and second side beams 112", 114" may also define apertures or orifices 142". The orifices 142" may also be arranged in a pattern or array that matches the pattern or array of the orifices 141" defined by the support arms 138". Fasteners 144" may extend through the orifices 141" defined by the support arms 138", into the orifices 142" defined by the first and second side beams 112", 114", and engage the first and second side beams 112", 114" to secure the orifices 142" to the first and second side beams 112", 114". For example, orifices 141" may be through holes, orifices 142" may be tapped orifices, and threads on the fasteners 144" may engage the tapped orifices 142" to secure the support arms 138" to the first and second side beams 112", 114". Alternatively, both sets of orifices 141", 142" may be through holes and fasteners 144" may be rivets.

The orifices 142" defined by the first and second side beams 112", 114" may be defined by eyelets 146" that form portions of the first and second side beams 112", 114". Such eyelets 146" may disposed within openings 148" defined by the first and second side beams 112", 114". The eyelets 146" may be secured to lower rails 150" and upper rails 152" that form portions of the first and second side beams 112", 114". Ribs 154" may extend from the eyelets 146" to the lower rails 150" or upper rails 152" to provide additional structural support and may increase the structural rigidity of the frame 102" (or more specifically the first and second side beams 112", 114") proximate to the openings 148".

Figure 16:
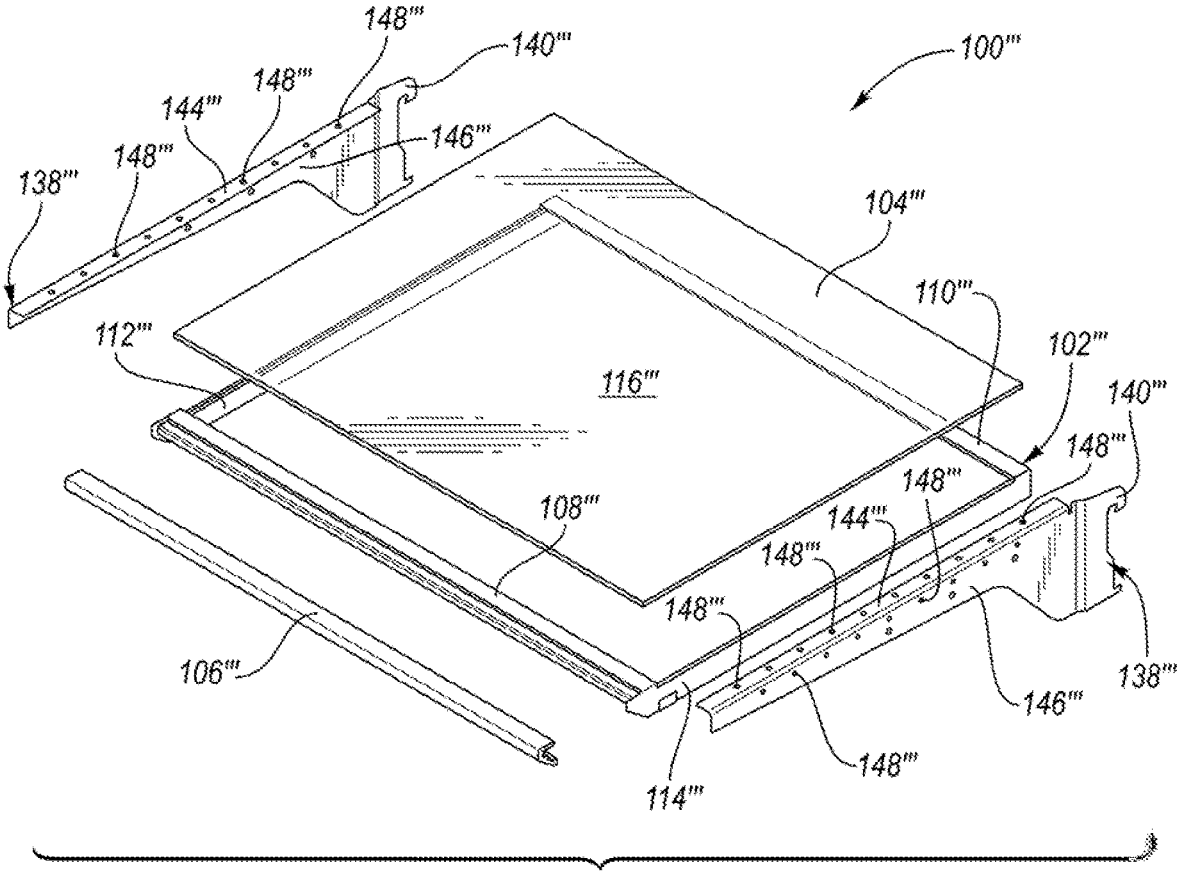
FIG. 16 is an exploded view of a fourth embodiment of the refrigerator shelf.
Figure 17:
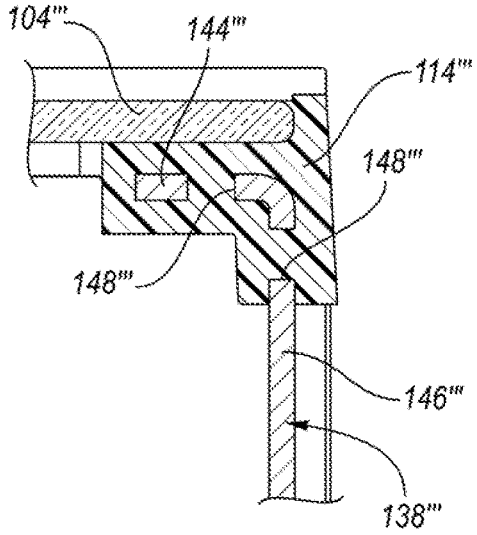
FIG. 17 is a partial cross-sectional view of the fourth embodiment of the refrigerator shelf illustrating the engagement between support arm and frame of the fourth embodiment of the refrigerator shelf.

Referring to FIGS. 16 and 17, a fourth embodiment of the refrigerator shelf 100'" is illustrated. The fourth embodiment of the refrigerator shelf 100'" may be construed to include all of the elements, subcomponents, and functionality of the first embodiment of the refrigerator shelf 100, the second embodiment of the refrigerator shelf 100', and/or the third embodiment of the refrigerator shelf 100", unless otherwise stated or illustrated herein. It should further be understood that any component having a callout number in FIGS. 16 and 17 that includes a triple prime symbol ("') may be construed as having the same structure, subcomponents, and functionality as a component illustrated in FIGS. 3-10 that includes the same callout number but without the prime symbol, a component illustrated in FIGS. 11-13 that includes the same callout number but with only one the prime symbol, and/or a component illustrated in FIGS. 14-15 that includes the same callout number but with only two the prime symbols unless otherwise stated or illustrated herein.

The fourth embodiment of the refrigerator shelf 100'" may be utilized as a shelf within a compartment of the refrigerator 10 (e.g., the fresh food compartment 12 or the freezer compartment 14). For example, the shelf 100'" may be utilized as shelf 15 illustrated in FIG. 2. The shelf 100'" includes a frame 102'", a panel or plate 104'" (e.g., a glass plate) that is configured to support items (e.g., food items) that are disposed within the refrigerator 10, and a trim or edge cover 106'". The frame 102'" provides structural support for the plate 104'".

The frame 102''' includes a front beam 108''', a rear beam 110''', a first side beam 112''', and a second side beam 114'''. The front beam 108''' is spaced-apart from the rear beam 110'''. The first side beam 112''' is spaced-apart from the second side beam 114'''. The front beam 108''' and rear beam 110''' each span and are each secured to the first and second side beams 112''', 114''' such that a central opening 116''' is defined between the front beam 108''', rear beam 110''', first side beam 112''', and second side beam 114'''. The plate 104''' spans the front beam 108''' and rear beam 110''', and spans the first and second side beams 112''', 114''' such that the plate 104''' is disposed within an entirely of the central opening 116'''. The front beam 108''', rear beam 110''', first side beam 112''', and/or second side beam 114''' may encapsulate an outer peripheral edge of the plate 104'''.

The refrigerator shelf 100''' further includes support arms 138'''. More specifically, the support arms 138''' may include first and second support arms, which may be mirror images of each other. Therefore, it should be understood that the description of one of the support arms 138''' is applicable to the other of the support arms 138''' keeping in mind that the support arms 138''' are mirror images of each other. The support arms 138''' are configured to engage the refrigerator 10 to position the shelf 100''' within the refrigerator 10. More specifically, the support arms 138''' may be configured to engage a wall 13 (e.g., the rear wall 13) within the fresh food compartment 12 or the freezer compartment 14 to position the shelf 100''' within the fresh food compartment 12 or the freezer compartment 14.

The support arms 138''' may each include hooks 140''' extending outward from rearward regions of the support arms 138'''. The hooks 140''' may be configured to engage the refrigerator 10 to position the shelf 100''' within the refrigerator 10. More specifically, the hooks 140''' may be configured to engage orifices or slots (not shown) defined by a wall 13 (e.g., the rear wall 13) within the fresh food compartment 12 or the freezer compartment 14 to position the shelf 100''' within the fresh food compartment 12 or the freezer compartment 14. Such orifices or slots may be arranged in a "ladder" configuration that includes a plurality of orifices or slots so that the hooks 140''' may engage the orifices or slots arranged at different heights to adjust the height of the shelf 100''' within the fresh food compartment 12 or the freezer compartment 14.

The support arms 138''' each include a flange 144''' that extends laterally outward from an upper region of a side plate 146''' of the corresponding support arm 138'''. The flanges 144''' may extend laterally inward along the upper regions of the support arms 138''' with respect to the frame 102''' and plate 104''' once the support arms 138''' are assembled onto or secured to the frame 102'''. A first of the support arms 138''' may be secured to the first side beam 112''' while a second of the support arms 138''' is secured to the second side beam 114'''. The side plates 146''' and flanges 144''' of each support arm 138''' may define orifices 148'''. The orifices 148''' may be arranged in a pattern or in an array. For example, the orifices 148''' may be arranged in a linear pattern extending from front ends toward rear ends of the support arms 138'''. The positions or the orifices 148''' along the flange 144''' may be staggered relative to the orifices 148''' along the side plate 146'''. The support arms 138''' may be secured to the first and second side beams 112''', 114''' via an over molding process. For example, the first and second side beams 112''', 114''' may be over molded onto the support arms 138''' such that some of the material that forms the first and second side beams 112''', 114''' extends into the orifices 148''' defined along the side plates 146''' and flanges 144''' of the support arms 138'''. Such a configuration operates to secure the support 138''' to the first and second side beams 112''', 114'''.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator shelf comprising:

a plate configured to support items disposed within a refrigerator;

a frame (i) supporting the plate and (ii) having first and second side beams, wherein the first and second side beams each have a forward-facing surface and a rearward-facing surface; and first and second support arms having first and second flanges, respectively, the first and second flanges extending laterally inward along upper regions of the first and second support arms, respectively, wherein (i) the first support arm has first and second tabs extending upward from forward and rearward ends of the first flange, respectively, (ii) the second support arm has third and fourth tabs extending upward from forward and rearward ends of the second flange, respectively, and (iii) the first and second support arms have hooks extending outward from rearward regions of the first and second support arms, wherein the frame is coupled to the first and second support arms via (a) the first and second side beams engaging upper surfaces of the flanges of the first and second support arms, respectively, (b) the first and se engaging the forward-facing and rearward-facing surfaces of the first side beam, respectively, and (c) the third and fourth tabs engaging the forward-facing and rearward-facing surfaces of the second side beam, respectively, and wherein the hooks are configured to engage the refrigerator to position the shelf within the refrigerator.

2. The refrigerator shelf of claim 1, wherein the first and second side beams have first and second braces extending downward therefrom, respectively and wherein the forward-facing and rearward-facing surfaces are defined along the first and second braces.

3. The refrigerator shelf of claim 2, wherein the first and second braces comprise arrangements of longitudinally extending girders and transversely extending ribs.

4. The refrigerator shelf of claim 1, wherein (i) the first tab and the forward-facing surface of the first side beam collectively include a first snap, (ii) the second tab and the rearward-facing surface of the first side beam collectively include a second snap, (iii) the third tab and the forward-facing surface of the second side beam collectively include a third snap, and (iv) the fourth tab and the rearward-facing surface of the second side beam collectively include a fourth snap, wherein (a) the first and second snaps are configured to secure the first support arm to the first side beam and (b) the third and fourth snaps are configured to secure the second support arm to the second side beam.

5. The refrigerator shelf of claim 4, wherein (i) the first snap includes a first ramped tab extending from the forward-facing surface of the first side beam and a first orifice defined by the first tab, (ii) the second snap includes a second ramped tab extending from the rearward-facing surface of the first side beam and a second orifice defined by the second tab, (iii) the third snap includes a third ramped tab extending from the forward-facing surface of the second beam and a third orifice defined by the third tab, and (iv) the fourth snap includes a fourth ramped tab extending from the rearward-facing surface of the second side beam and a fourth orifice defined by the fourth tab.

6. The refrigerator shelf of claim 1, wherein (i) bosses extend downward from the first and second side beams, (ii) the first and second flanges define orifices, iii) the bosses of the first side beam extend into the orifices defined by the first flange to couple the first support arm to the first side beam, and (iv) the bosses of the second side beam extend into the orifices defined by the second flange to couple the second support arm to the second side beam.

7. The refrigerator shelf of claim 1, wherein the first and second side beams have protrusions extending outward from opposing sides of the forward-facing surfaces, and wherein the protrusions are configured to engage opposing sides of the first and third tabs to restrict lateral movement of the first and second support arms relative to the frame.

8. The refrigerator shelf of claim 1, wherein the frame encapsulates the plate.

9. A refrigerator shelf comprising:

a plate configured to support items disposed within a refrigerator;

a frame (i) supporting the plate and (ii) having a brace extending downward from a bottom surface of the frame, the brace having an edge; and a support arm having (i) a flange extending laterally along an upper region of the support arm and (ii) a tab extending upward from an end of the flange, wherein the frame is coupled to the support arm via (a) the brace engaging an upper surface of the flange and (b) the tab engaging the edge of the brace, and wherein the support arm is configured to engage the refrigerator to position the shelf within the refrigerator, the tab and the edge of the brace collectively include a snap configured to secure the support arm to the frame, and the snap includes a ramped tab extending from the edge of the brace and an orifice defined by the tab.

10. The refrigerator shelf of claim 9, wherein the brace has a second edge, the support arm has a second tab extending upward from a second end of the flange, and wherein the frame is further coupled to the support arm via the second tab engaging the second edge of the brace.

11. The refrigerator shelf of claim 9, wherein the brace comprises an arrangement of longitudinally extending girders and transversely extending ribs.

12. The refrigerator shelf of claim 9, wherein at least one boss extends downward from the brace, the flange defines at least one orifice, and the at least one boss extends into the at least one orifice of the flange to couple the support arm to the frame.

13. The refrigerator shelf of claim 9, wherein the brace has protrusions extending outward from opposing sides of the edge, and wherein the protrusions are configured to engage opposing sides of the tab to restrict lateral movement of the support arm relative to the frame.

14. The refrigerator shelf of claim 9, wherein the frame encapsulates the plate.

15. A refrigerator shelf comprising:

a plate configured to support items disposed within a refrigerator;

a frame (i) supporting the plate and (ii) having an array of bosses extending downward from a bottom surface of the frame; and a support arm having a flange extending laterally along an upper region of the support arm, wherein the (i) flange defines an array of orifices and (ii) the frame is coupled to the support arm via the array of bosses engaging the frame within the array of orifices, wherein the support arm is configured to engage the refrigerator to position the shelf within the refrigerator, wherein (a) the frame has a side beam, (b) the side beam has a forward-facing surface and a rearward-facing surface, and (c) the flange has first and second tabs extending upward from forward and rearward ends of the flange, and wherein the frame is further coupled to the support arm via the first and second tabs engaging the forward-facing and rearward-facing surfaces of the side beam, respectively.

16. The refrigerator shelf of claim 15, wherein the side beam has a brace extending downward therefrom, and wherein the forward-facing and rearward-facing surfaces are defined along the brace.

17. The refrigerator shelf of claim 16, wherein the brace comprises an arrangement of longitudinally extending girders and transversely extending ribs.

18. The refrigerator shelf of claim 15, wherein (i) the first tab and the forward-facing surface of the side beam collectively include a first snap and (ii) the second tab and the rearward-facing surface of the side beam collectively include a second snap, and wherein the first and second snaps are configured to secure the support arm to the side beam.

19. The refrigerator shelf of claim 15, wherein the side beam has protrusions extending outward from opposing sides of the forward-facing surface, and wherein the protrusions are configured to engage opposing sides of the first tab to restrict lateral movement of the support arm relative to the frame.

20. The refrigerator shelf of claim 15, wherein the frame encapsulates the plate.

* * * * *